US005141113A

United States Patent [19]

Elliott

[11] Patent Number: 5,141,113

[45] Date of Patent: Aug. 25, 1992

[54] JEWELRY ORGANIZER

[76] Inventor: Jean P. Elliott, 5313 Tidwell Hollow Rd., Nashville, Tenn. 37218

[21] Appl. No.: 825,099

[22] Filed: Jan. 24, 1992

[51] Int. Cl.[5] ..... A47F 7/00

[52] U.S. Cl. ..... 211/13; 211/118; 206/495

[58] Field of Search ..... 211/13, 113, 118, 87; 206/495, 6.1

[56] References Cited

U.S. PATENT DOCUMENTS

| | | | |
|---|---|---|---|
| 4,401,219 | 8/1983 | Mink | 206/495 X |
| 4,767,011 | 8/1988 | Butler | 211/13 |
| 4,846,430 | 7/1989 | Ke | 211/87 X |
| 4,930,635 | 6/1990 | Hotchkiss et al. | 206/495 |
| 4,966,287 | 10/1990 | Snyder | 211/13 |
| 5,025,918 | 6/1991 | Bergeron | 206/495 X |
| 5,027,960 | 7/1991 | Rainville | 211/118 |

*Primary Examiner*—Robert W. Gibson, Jr.
*Attorney, Agent, or Firm*—Abe Hatcher

[57] ABSTRACT

A jewelry organizer made of parallel strips of flexible porous material adhered at intervals from top to bottom to a continuous sheet of flexible plastic each preferably having a dowel along at least one of its top or bottom edges. The top strip may have a dowel along its top edge in addition to a flexible dowel along its bottom edge. The bottom strip may have a dowel along its top edge and also be adhered to the continuous sheet of flexible plastic along its two sides and its bottom edge to form a pocket, which may be divided into a plurality of compartments, if desired. There may also be hangers or hooks on the back in the area of the top strip dowel. The strips between the top strip and the bottom strip preferably have a dowel along the lower edge of each and are adhered to the continuous sheet of flexible plastic along a top edge of each.

13 Claims, 2 Drawing Sheets

JEWELRY ORGANIZER

BACKGROUND OF THE INVENTION

1. Field of the Invention

This invention relates to a device for displaying and storing jewelry. More particularly, it relates to an organizer for earrings.

2. Description of the Prior Art

Butler, in U.S. Pat. No. 4,767,011, discloses an enclosed frame with a loosely stretched flexible mesh material across a frame opening for attaching earrings thereto. Corbett, in U.S. Pat. No. 4,905,821, describes a panel of woven material or mesh stretched and mounted to an inner frame fitted into a recess or groove in an outer frame. The devices of both of these patents require reaching around a frame to get to the back and will not display cliptype earrings.

SUMMARY OF THE INVENTION

After extended investigation I have devised a jewelry display device made up of a continuous strip of transparent, translucent, clear or colored plastic having attached, affixed or adhered thereto a plurality of substantially parallel strips of flexible porous material attached along at least one edge or length of each so as to enable a person to reach behind between a strip and the plastic. The strips of flexible porous material may be affixed by adhesives, stitching or the like. By porous I mean material having pores or holes therein. The earring sorter of the invention may have a single or plural pocket at its bottom formed by adhering the bottommost strip of flexible porous material to the plastic sheet along its two sides and bottom edge, leaving the top edge loose or open. If plural, the pocket is divided into two or more compartments. I prefer to employ a top dowel along the upper length of the uppermost strip, the strip going around the dowel to hold it in place, and a flexible dowel, preferably of less diameter than the top dowel, along the upper length of the lowermost strip of flexible porous material. Remaining dowels according to the invention may be along the lower length of each strip between the uppermost and the lowermost. There may be one or more hangers or clips fastened to the back of the top dowel, which may be of wood.

BRIEF DESCRIPTION OF THE DRAWING

For a better description of the invention reference will now be made to the drawing in which.

DETAILED DESCRIPTION

Figure 1:
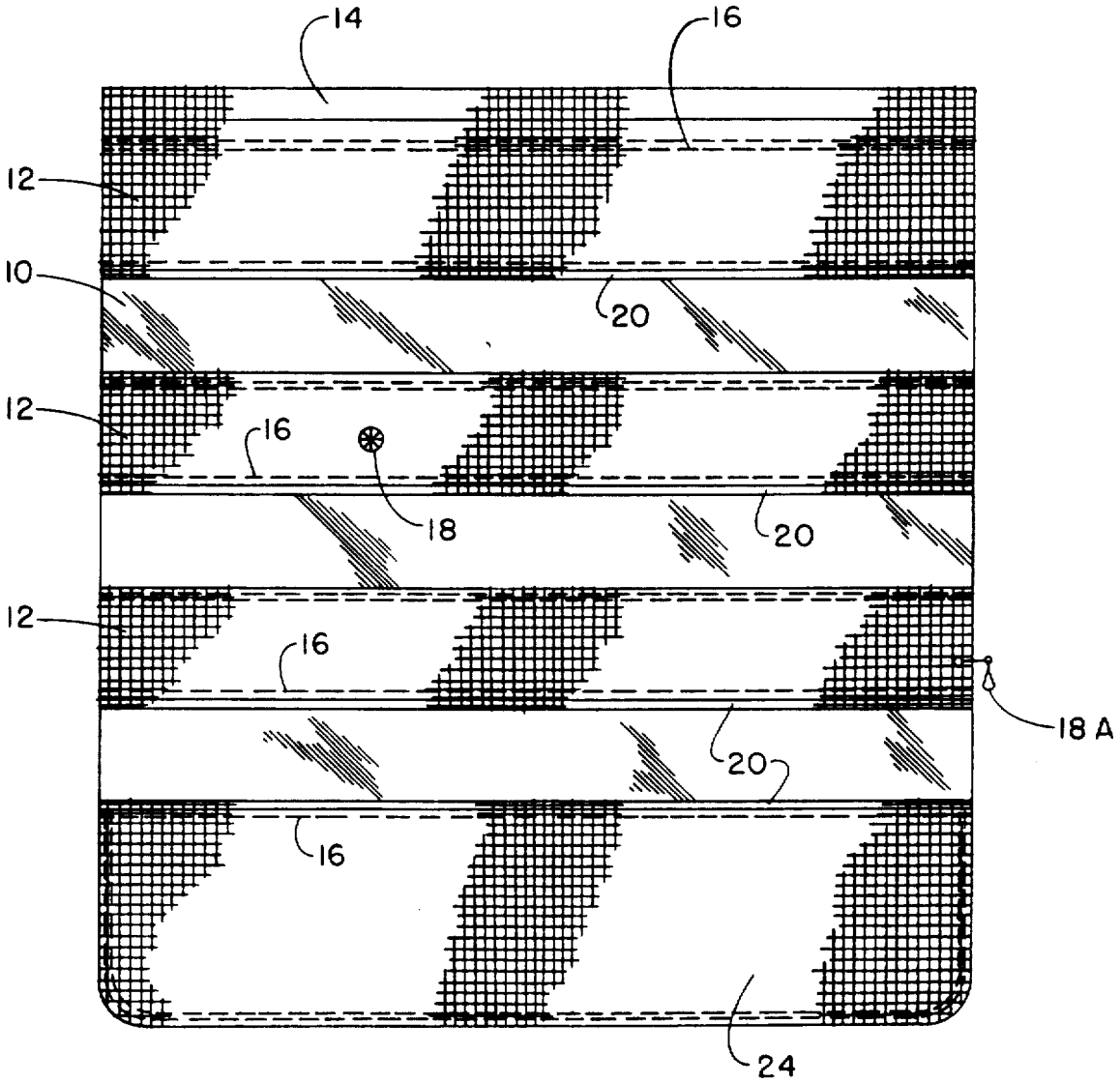
FIG. 1 is a front view or plan view of the jewelry organizer of the invention.
Figure 2:
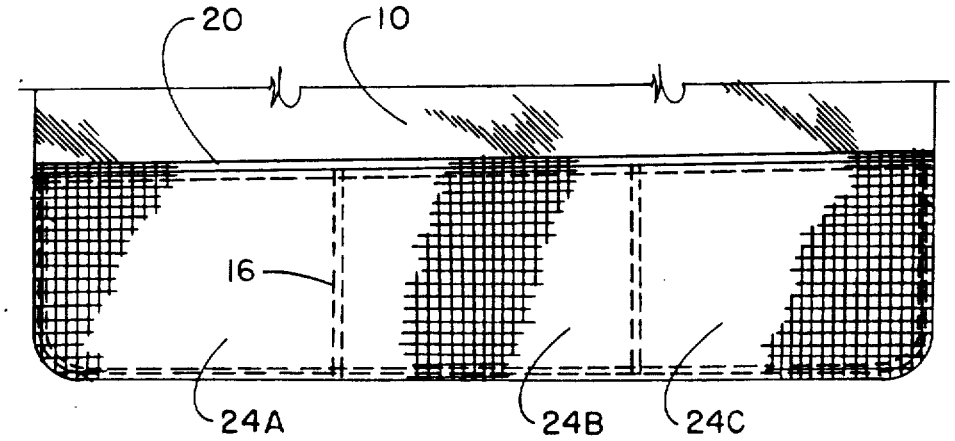
FIG. 2 is a cut-away view showing the bottom portion of the jewelry organizer of FIG. 1, including three compartments of a bottom pocket.
Figure 3:
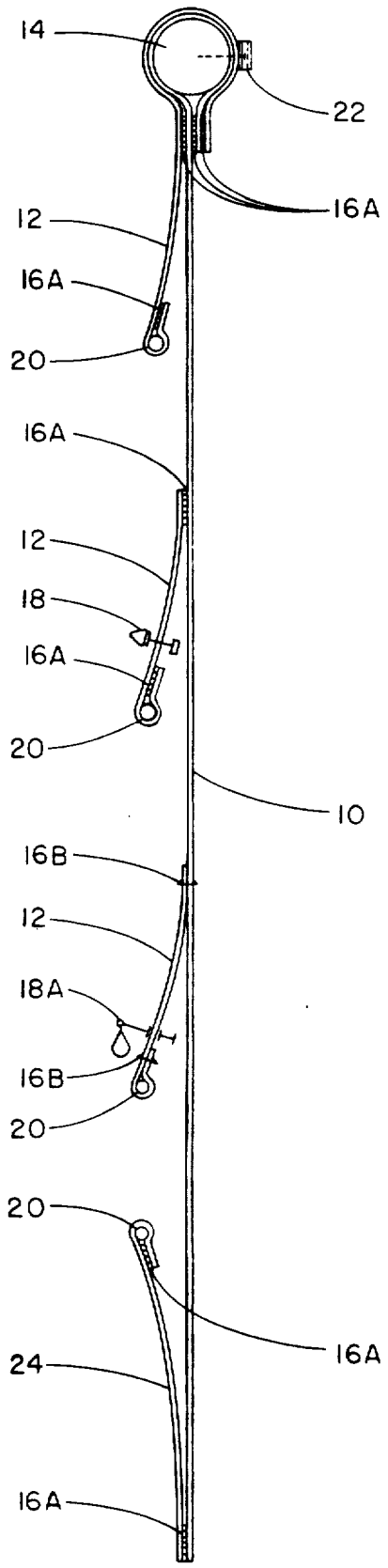
FIG. 3 is a view from one side of the jewelry organizer shown in FIG. 1.

The earring sorter of the invention shown in FIGS. 1, 2 and 3 is made up of a continuous sheet of plastic 10 having one edge of a plurality of parallel strips of porous material 12 adhered thereto at intervals along its length by stitching 16 or adhesive 16A such as a paste, glue or the like and loose except where attached so that they may flap out slightly at an angle from the sheet 10 so as to aid getting behind to affix a clip-type earring 18A thereto. The porous material 12 preferably encircles a dowel 14 going along an upper length of the uppermost strip. Other, preferably smaller, flexible dowels 20 are also encircled by the flexible porous material 12 as they run along a lower edge of each strip thereof. The sheet of plastic must also be flexible so as to bend with the porous material to strips of which it is attached. Pierce-type earrings 18 may also be displayed on the jewelry organizer of the invention as depicted in FIGS. 1 and 3. A clamp or hanger 22 may be used on the back of top dowel 14 as shown in FIG. 3. A lowermost strip of flexible porous material 24, instead of having a dowel at its bottom as the other strips do may have a dowel along its top edge and may, if desired, be divided into a plurality of compartments such as 24A, 24B and 24C of FIG. 2 or a single pocket such as that of FIG. 1 by stitching or gluing the flexible plastic sheet and the bottommost strip of flexible porous material together along the two sides and the bottom edge or length of the strip.

While the invention has been described in terms of certain preferred embodiments thereof, the claims appended hereto are intended to encompass all embodiments which fall within the scope of the invention.

Having thus described my invention and certain preferred embodiments thereof, I claim:

1. A jewelry organizer which comprises a continuous sheet of flexible plastic having a plurality of strips of flexible porous material arranged in a parallel manner at intervals along said sheet from an upper end thereof adapted to be affixed to a surface for hanging to a lower end thereof, said strips being attached to said continuous sheet of flexible plastic along at least one length of each.

2. The jewelry organizer of claim 1 wherein one strip of said plurality of strips of flexible porous material at said upper end of said continuous sheet of flexible plastic goes around a dowel along an upper length thereof for aiding in hanging.

3. The jewelry organizer of claim 1 wherein each of said plurality of strips of flexible porous material goes around a dowel along at least one length thereof.

4. The jewelry organizer of claim 1 wherein an uppermost strip of said plurality of strips of porous material at said upper end has a dowel along the length of an upper edge thereof and a dowel along the length of a lower edge thereof.

5. The jewelry organizer of claim 1 wherein a lowermost strip of said plurality of strips of flexible porous material at said lower end has a sole dowel running along an upper edge of said strip, said strip going around said dowel and being attached on both sides and a bottom thereof to said continuous sheet of flexible plastic.

6. The jewelry organizer of claim 1 wherein an uppermost strip of said plurality of strips of flexible porous material at said upper end goes around a dowel along an upper edge thereof and a lowermost strip at the lower end of said plurality of strips of flexible porous material has a sole dowel running along an upper edge of said strip with said strip going therearound.

7. The jewelry organizer of claim 1 having at least one hanger attached to a back side thereof at said top end.

8. The jewelry organizer of claim 1 wherein said plurality of strips of flexible porous material are attached to said continuous sheet of flexible plastic by stitching.

9. The jewelry organizer of claim 1 wherein said plurality of strips of flexible porous material are attached to said continuous sheet of flexible plastic material by an adhesive.

10. The jewelry organizer of claim 1 wherein an uppermost strip of said plurality of strips of porous material at said upper end of said continuous sheet of flexible plastic goes around a dowel along its length from side to side, a lowermost strip of said plurality of strips of flexible porous material goes around a flexible dowel going along an upper edge of said lowermost strip and said lowermost strip is attached to said continuous sheet of flexible plastic on two sides of said lowermost strip and a bottom edge of said lowermost strip and of said continuous sheet of flexible plastic, whereby a bottom pocket is formed, and each of remaining strips of said flexible porous material is affixed at intervals between said uppermost strip and said lowermost strip to said continuous sheet of flexible plastic material along an upper edge of each and an upper edge of each runs around a flexible dowel extending along a lower edge of each.

11. The jewelry organizer of claim 10 wherein said bottom pocket is divided into a plurality of compartments.

12. A jewelry organizer comprising a plurality of strips of flexible porous material attached in parallel manner at intervals to a continuous sheet of flexible plastic from a top to a bottom thereof, and uppermost of said plurality of strips running around a first dowel along a top end of said sheet and being attached to said top end, a lowermost of said plurality of strips running around a flexible dowel along an upper edge of said lowermost strip and being attached along two sides and a bottom of said lowermost strip and bottom of said continuous sheet of flexible plastic, whereby a pocket is formed, and each remaining strip of said plurality of strips between said uppermost strip and said lowermost strip running around a dowel along a bottom length from a side of said strip to an opposite side of said strip.

13. The jewelry organizer of claim 12 wherein said pocket is divided into a plurality of compartments.

* * * * *